United States Patent [19]

Applegate et al.

[11] 4,408,908

[45] Oct. 11, 1983

[54] RIBBON FEED SYSTEM FOR A MATRIX PRINTER

[75] Inventors: Steven L. Applegate; James J. Molloy, both of Lexington, Ky.

[73] Assignee: International Business Machines Corporation, Armonk, N.Y.

[21] Appl. No.: 218,228

[22] Filed: Dec. 19, 1980

[51] Int. Cl.[3] ..... B41J 3/04

[52] U.S. Cl. ..... 400/120; 400/225; 400/229; 400/234; 400/235.1; 346/76 R

[58] Field of Search ..... 400/120, 194, 195, 196, 400/196.1, 208, 218, 225, 228, 229, 232, 233, 234, 235.1; 101/460; 242/75.2, 75.3; 346/76 R, 76 PH, 151, 165; 219/216

[56] References Cited

U.S. PATENT DOCUMENTS

| | | | |
|---|---|---|---|
| 2,713,822 | 7/1955 | Newman | 101/460 X |
| 2,838,250 | 6/1958 | Stavrakis et al. | 242/75.2 X |
| 3,442,366 | 5/1969 | Spears | 400/234 |
| 3,623,122 | 11/1971 | Fotland | 346/165 |
| 3,744,611 | 7/1973 | Montanari et al. | 400/120 |
| 3,804,227 | 4/1974 | Cappotto et al. | 400/208 |
| 3,841,459 | 10/1974 | Buschmann et al. | 400/225 X |
| 3,855,448 | 12/1974 | Hanagata et al. | 400/120 X |
| 3,877,561 | 4/1975 | Guerrini et al. | 400/208 |
| 3,891,991 | 6/1975 | Hurst | 346/165 |
| 3,904,015 | 9/1975 | Boyden et al. | 400/196.1 X |
| 3,939,957 | 2/1976 | Bittner | 400/229 X |
| 3,960,259 | 6/1976 | Guerrini et al. | 400/208 |
| 3,974,982 | 8/1976 | Stone | 242/198 X |
| 4,033,445 | 7/1977 | Oddicini | 400/208 |
| 4,145,697 | 3/1979 | Ballinger | 346/165 |
| 4,147,439 | 4/1979 | Colecchi | 400/208 |
| 4,195,937 | 4/1980 | Baran | 400/120 |
| 4,232,976 | 11/1980 | Bernardis et al. | 400/195 X |
| 4,252,450 | 2/1981 | Goodman et al. | 400/208 |
| 4,300,847 | 11/1981 | Hoffman et al. | 400/196.1 |
| 4,303,345 | 12/1981 | Lada | 400/229 |
| 4,329,071 | 5/1982 | Applegate et al. | 219/216 X |
| 4,329,075 | 5/1982 | Applegate et al. | 400/120 X |
| 4,345,845 | 8/1982 | Bohnhoff et al. | 400/120 |

FOREIGN PATENT DOCUMENTS

| | | | |
|---|---|---|---|
| 2821135 | 11/1979 | Fed. Rep. of Germany | 400/196.1 |
| 1064807 | 4/1967 | United Kingdom | 242/75.3 |

OTHER PUBLICATIONS

Xerox Disclosure Journal, "Ribbon Feed Rolls", Plaza, vol. 1, No. 2, Feb. 1976, pp. 43–44.

IBM Technical Disclosure Bulletin, "Ribbon Drive", Darwin, vol. 19, No. 4, Sep. 1976, pp. 1407–1408.

IBM Technical Disclosure Bulletin, "Gear Drive Ribbon Reversing Mechanism", Nolden et al., vol. 20, No. 2, Jul. 1977, pp. 728–729.

IBM Technical Disclosure Bulletin, "Variable Pitch Ribbon Feed", Greer, vol. 20, No. 3, Aug. 1977, pp. 1072–1073.

Xerox Disclosure Journal, "Ribbon Advance Mechanism", Mikes, vol. 2, No. 4, Jul./Aug. 1977, p. 47.

*IBM* 5100 *Basic Reference Manual,* Fourth Edition (Jul. 1977), pp. 173–175.

*Primary Examiner*—Ernest T. Wright, Jr.

*Attorney, Agent, or Firm*—John A. Brady; George E. Grosser

[57] ABSTRACT

A ribbon feed system for a matrix printer utilizes metering rollers located on the printhead carrier to maintain a substantially zero ribbon velocity relative to the receiving medium with an on-carrier ribbon feed. By coordinating roller rotation with carrier motion, relative motion that would tend to cause smearing during mark formation is avoided. For printers that inject current into the ribbon to cause printing, friction drag is reduced and tension control is simplified by collecting current at the metering rollers for return to the printhead energizing circuitry. Such dual use of the metering rollers takes advantage of the firm intimate contact that exists for metering to establish a high quality electrical connection. A tension controlled brake at the ribbon supply serves to assure tensions are held within a narrow range at the printhead with such a ribbon metering system.

12 Claims, 6 Drawing Figures

RIBBON FEED SYSTEM FOR A MATRIX PRINTER

BACKGROUND OF THE INVENTION

1. Technical Field of the Invention

The present invention relates to ribbon feed systems for matrix printers.

2. Description Regarding the Art

Matrix-type ribbon printers present special ribbon feed problems particularly when the printing process requires uninterrupted electrical contact between the printhead and the ribbon. For such printing, the ribbon has typically been laid out along the print line and the printhead then scans the ribbon. By first laying out fresh ribbon along the print line, ribbon motion relative to the receiving medium, which would tend to cause smearing, is avoided.

U.S. Pat. No. 4,195,937 describes a number of ribbon feed configurations. All of the configurations use supply and takeup reels located off the printhead carrier, an arrangement that complicates ribbon loading and threading. Prior to a printing scan along the print line, the ribbon is clamped in place. For one configuration, a barlike clamp serves to collect printing current. And, for most of the configurations described, the operator must look to the pattern on the ribbon to inspect the material printed on the present print line. One of the configurations does route the ribbon to permit viewing of the print line with the ribbon clamped in place. Printing current for this configuration is collected by a conducting bar and/or a roller that redirects the ribbon from the print line.

U.S. Pat. No. 3,855,448 describes, for one implementation, an on-carrier ribbon feed, but it appears that intermittant printhead contact is intended rather than a sweeping movement. Indeed, with the drive described, the ribbon would tend to move relative to the receiving medium unless the printhead carrier is at a standstill. Also, the type of printhead described does not involve the complication to ribbon feeding of collecting printing currents from the ribbon.

SUMMARY OF THE INVENTION

The present invention is directed most particularly to printers that sweep an array of electrodes along a print line in contact with a ribbon and selectively inject currents into the ribbon to cause ink transfers to a receiving medium. According to the invention, a cooperating pair of metering rollers are arranged on the printhead carrier and are coupled to directly drive the ribbon past the printhead, as printing occurs, at a rate corresponding to printhead motion. By so driving the ribbon, a substantially zero ribbon velocity (relative to the receiving medium) occurs at the instantaneous print point. Since such operation does not require ribbon clamping to a motionless member, such as the platen or printer frame, to achieve a zero ribbon velocity, a fully on-carrier ribbon feed arrangement is possible with attendant opportunities for ribbon loading convenience.

Ribbon feed rate control for a system where carrier motion is transmitted to the ribbon takeup reel, it should be appreciated, cannot be coordinated to achieve a zero relative ribbon velocity since the metering rate for such an arrangement varies as a function of the outer radius of the ribbon already wound on the reel.

As a further aspect of the invention, one or both of the metering rollers is connected electrically to return printing currents from the ribbon to the current source. By so providing for a dual use of the metering rollers, advantage is taken of the intimate firm ribbon contact that exists for metering to achieve a high quality electrical connection. With this arrangement, no contact drag on the ribbon is added incident to collecting printing current. And, elimination of contact drag simplifies tension control around the printhead which, for high resolution printing, has many (e.g. forty) somewhat delicate projecting electrodes.

To complement the low friction achieved by collecting current at the metering rollers, a presently preferred implementation for the invention employs a tension actuated ribbon brake that controls the release of ribbon from the on-carrier supply and maintains the tension on the supply side of the metering rollers within a narrow range. Preferably, a tension actuated arm controls release of the ribbon brake in accordance with the length of a loop of ribbon and has an extended loop tensioning range with the brake applied. With an extended range for tensioning a ribbon loop, the arm serves to prevent slack between the supply and the metering rollers and prevents folding or buckling of the ribbon that could cause smearing and possibly printhead damage. The amount of slack takeup provided is preferably adequate to keep the ribbon tight when the printhead is retracted or when reverse metering occurs at the beginning of a printing scan.

As a further aspect of the invention, carrier motion is coupled by a belt drive to wind ribbon at the takeup. The belt drive is controlled by a tension actuated arm that increases belt slippage as ribbon tension increases on the takeup side of the metering rollers.

With the cooperation of components described above, accurately controlled low tension levels are achieved with an on-carrier ribbon feed while also maintaining a substantially zero velocity level for the ribbon at the print point during printing. Moreover, no additional drag on the ribbon results from current collection, thereby simplifying the problems of controlling ribbon tension profiles in printers where current collection is required for printing.

A presently preferred implementation of the invention will now be described with reference to the drawing wherein.

Figure 1:
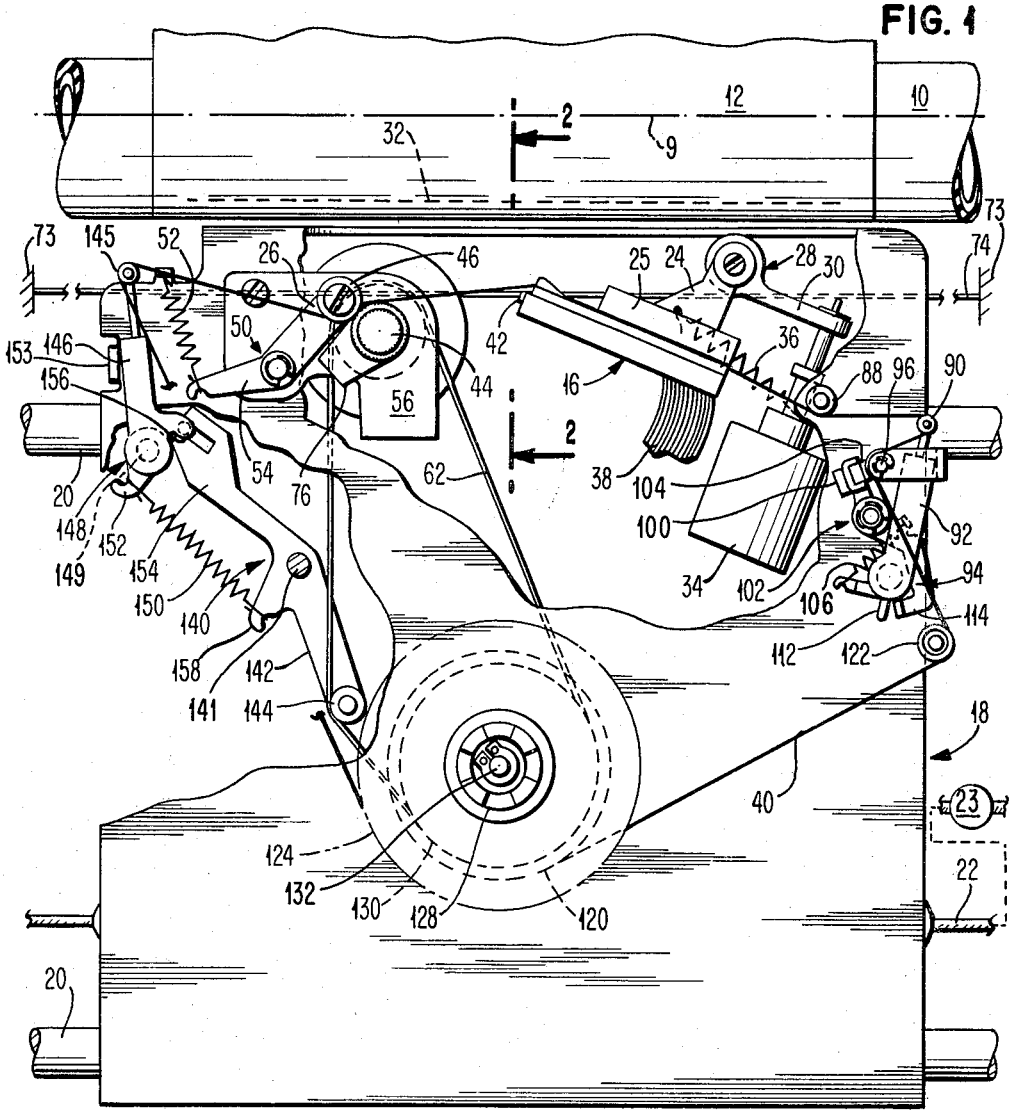
FIG. 1 is a plan view of a ribbon feed system according to the invention.

Referring to FIG. 1, a presently preferred printer configuration incorporating the invention includes an elongate platen 10 that is adapted to support a medium 12 such as a sheet of paper for receiving printing marks. To effect printing movements, a carrier 18 is mounted on guide rails 20 for movement parallel to the longitudinal axis 9 of the platen 10. Drive motion is coupled to the carrier 18 by a cable 22 connected to a drive system 23 (shown illustratively) as is well known in the art.

The printhead 16 is mounted at a mounting plate 25 on one arm 24 of a pivot member 28 which is pivotally mounted on the carrier 18. Movement of the printhead 16 from a retracted position (shown) to an operative position at the print line 32 is effected by a solenoid 34 that is connected to a second arm 30 of the pivot member 28. A spring 36 serves to return the printhead 16 to the retracted position when the solenoid 34 is deenergized.

As will be discussed more fully below, the printhead 16 is of the type adapted to receive printing signals at a set of signal channels 38 and supply such signals to a printing ribbon 40 by means of respective electrodes 42 that are arranged in a line array.

Metering of the printing ribbon 40 is, according to the invention, effected by cooperating metering rollers 44 and 46 located on the carrier 18 on to the takeup side of the printhead 16 on the feed path of the printing ribbon 40.

Roller 44 is preferably arranged on the side of the ribbon 40 that faces the printhead 16 and is mounted at a fixed position on the carrier 18. Firm pressure contact with the ribbon 40 is achieved by mounting the roller 46 on an arm 26 of a pivoting member 50 and providing ribbon nipping force by means of a spring 52 acting on a second arm 54. For assembly convenience, both the roller 44 and the pivoting member 50 are mounted on a support bracket 56 that is fixedly mounted on the carrier 18.

Figure 2:
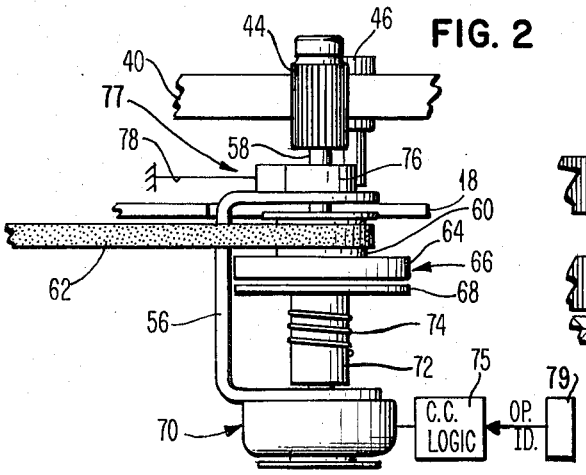
FIG. 2 is a side elevational view of a ribbon metering arrangement according to the invention.

Referring now to FIG. 2, a section view through line 2—2 of FIG. 1, the roller 44 is mounted on the carrier 18 to rotate with a shaft 58 that is connected to a pulley 60 around which a takeup drive belt 62 is positioned. Also connected to rotate with the shaft 58 is a first face plate 64 of a clutch 66 having a second face plate 68 that is moveable between an engaged and a disengaged position (shown) by a solenoid 70. Drive power is transmitted for rotating the second face plate 68 at a pulley section 72 that is wrapped by a cable 74 extending to the printer frame 73 (indicated symbolically in FIG. 1).

The wrap direction for the cable 74 is chosen to cause rotation for drawing ribbon 40 from the printhead 16 toward the rollers 44 and 46 for the printing direction (normally left to right) of motion by the carrier 18. The diameters of the pulley 72 and the roller 44 are preferably made equal to cause the ribbon velocity at the electrodes 42 to cancel the carrier velocity for achieving essentially a zero ribbon velocity relative to the receiving medium 12.

Clutch control logic 74 preferably receives coded signals from a printer control 79 indicating the nature of each print operation performed and selectively signals the solenoid 70 for engaging the clutch 66. The use of coded signals to identify printer operations is well known and the clutch control logic 75 preferably examines the coded print operation signals and causes engagement of the clutch 66 whenever a graphic printing operation is indicated. For high speed printing, more sophisticated control may be implemented that looks at a sequence of printing operations, for example, to eliminate any disengagement of the clutch 66 when a space operation is sandwiched between two graphic printing operations.

A less sophisticated control is achieved by utilizing a one-way clutch, for the clutch 66, that is engaged for all forward motion of the carrier 18.

At a wiper 77 (hidden by 76) for the shaft 58, an electrical connection 78 is made to permit current flow between the ribbon 40 and the roller 44 which is formed of a conducting material such as brass and is preferably knurled to assure intimate contact and firm gripping.

Figure 3:
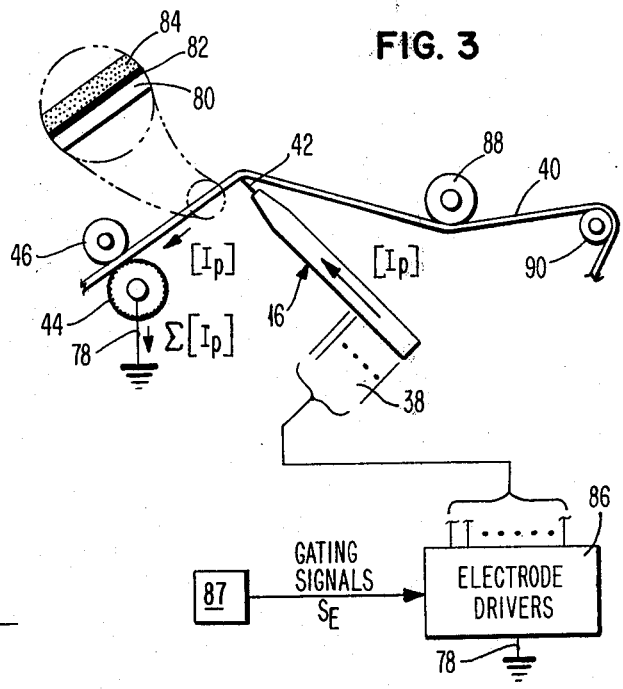
FIG. 3 is a pictoral diagram indicating printing current flows according to the invention.

Controlled printing currents (Ip) for the presently preferred implementation (see FIG. 3) are supplied to the ribbon 40 which includes an outer moderately resistive layer 80, an intermediate conducting aluminum layer 82 and an ink transfer layer 84. The currents (Ip) are collected by the roller 44 by contact with the moderately resistive layer 80. To improve the quality of connection still further, the roller 46 may also be used to establish a connection to the ribbon 40. For example, the aluminum layer 82 may be engaged at voids in the ink transfer layer 84 left by printing as described in U.S. Pat. No. 4,329,071, to S. L. Applegate and S. Dyer, filed June 30, 1980, and issued May 11, 1982. The printing currents (Ip) are supplied from a set of electrode drivers 86 which selectively control the occurrences of current applied to the respective electrodes 42 in accordance with gating signals $S_E$ from a printer controller 87 as is well known in the art. The currents Ip return to the electrode driver 86 through one or both of metering rollers 44 and 46 along a path 78 that may be a distinct conductor or may include metal portions of the printer.

Figure 4:
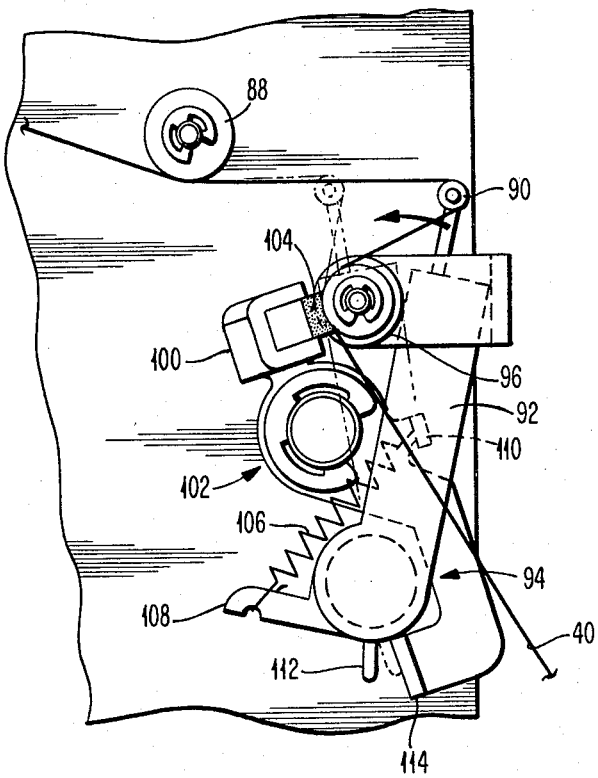
FIG. 4 is a detailed plan view of a supply side tension control according to the invention.

Referring now to FIG. 4, a roller 88 is mounted on the supply side of the feed path for the printing ribbon 40. The roller 88 directs the ribbon 40 at one end of a tension loop wrapping around a roller 90 that is located on a tension arm 92 of a pivot member 94. A roller 96 serves to define the other end of the tension loop and also serves to provide a clamping surface for brake action by a brake arm 100 of a pivot member 102. For the braking position shown, the ribbon 40 is clamped between a pad 104 mounted on the brake arm 100 and the roller 96.

Biasing force is applied to pivot members 94 and 102 by a spring 106 that is stretched between tab arms 108 and 110. As a result of the angular positions of tab arms 108 and 110 on pivot members 94 and 102, respectively, the biasing force urges arm 92 to increase the size of the loop of the ribbon 40 between rollers 88 and 96. Also, the biasing force tends to drive the brake arm 100 to a position for clamping the ribbon 40.

Release of the clamping action on the ribbon 40 is effected by a brake drive arm 112 of pivot member 94 that engages and coacts with a brake release arm 114 of pivot member 102 (the position of pivot member 92 for initial coaction is indicated in Phantom).

Figure 5:
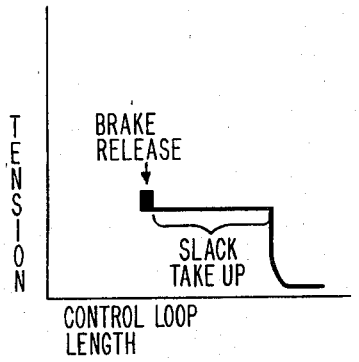
FIG. 5 is a diagram indicating the response properties of the supply tension control of FIG. 4.

The relationship of ribbon loop length and tension (see FIG. 5) that results with the above-described arrangement of pivot members 94 and 102 provides a narrow range of tension during normal printing for the section of the ribbon 40 extending past the printhead 16 to the metering rollers 44 and 46. Buckling or folding of the ribbon 40, which would result in smeared printing and possible printhead damage, is avoided by providing sufficient slack takeup to accommodate movement of the printhead 16 (see FIG. 1) to the retracted position and, also, any backup of the carrier 18 to provide for acceleration to printing speed. In this regard, it should be noted that it is preferred to permit reverse metering during backup motion at the start of printing so that ribbon 40 is not wasted as the backed over line section is "revisited" in accelerating to the next zone for printing on print line 32 (see FIG. 1). When the ribbon loop length falls to the point where brake drive arm 112 engages and displaces brake release arm 114, the ribbon 40 is released allowing ribbon tension to reach the ribbon supply reel 120 (see FIG. 1) which is located beyond a ribbon guide roller 122 that aids in defining the ribbon feed path.

Figure 6:
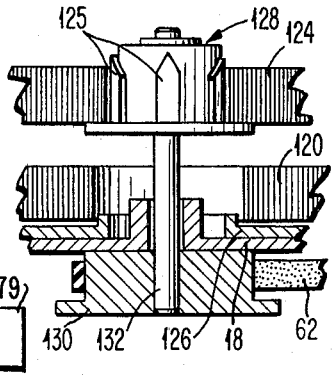
FIG. 6 is a cross section view indicating the arrangement of supply and takeup reels for the presently preferred implementation of the invention.

Referring to FIG. 6, a presently preferred concentric arrangement for supply and takeup of the ribbon 40 includes the supply reel 120 and a takeup reel 124. The supply reel 120 is free to rotate on a support disc 126 leaving control of tension on the supply side of the metering rollers 44 and 46 to the cooperating pivot members 94 and 102. A hub 128 receives the takeup reel 124 and includes keys 125 that prevent relative rotation. Motion for rotating the takeup reel 124 is transmitted by the drive belt 62 to a pulley 130 which is connected by a shaft 132 to the hub 128. Substantially uniform ribbon tension on the takeup side of the metering rollers 44 and 46 (see FIG. 1) is achieved by the action of a pivot member 140, pivoted on shaft 141, that includes a coupling control arm 142 on which a belt tensioning roller 144 is mounted. Tension in the ribbon 40 is sensed by guide 145 on arm 146 of a pivot member 148, pivoted on shaft 149, which is rotated against the bias of a stretched spring 150 acting on an arm 152 and arm 158 of member 140. While takeup exceeds the metering rate, the arm 146 is pulled away from a stop tab 153 and toward the metering rollers 44 and 46 by the ribbon 40. This motion is transmitted to an arm 154 of the pivot member 140 by a linkage arm 156 of the pivot member 148. As the ribbon 40 draws the arm 146 away from the stop tab 153, the above-described linkage arrangement causes the roller 144 to move toward the center of the path of the belt 62 reducing belt tension and eventually decoupling the pulleys 60 and 130 so as to eliminate ribbon takeup. As ribbon 40 again builds up on the takeup side of metering rollers 44 and 46, the stretched spring 150 is able to act on arm 152 and an arm 158 of pivot member 140 to force movement of the roller 144 to tighten the belt 62.

With such tension control, uniform tight wrapping of the takeup reel 124 is achieved.

The invention has been described in detail regarding presently preferred implementations thereof. However, it will be appreciated that variations and modifications are possible within the scope and spirit of the claimed invention.

For example, various non-concentric arrangements for supply and takeup reels may be employed and indeed supply or takeup ribbon need not be wound on reels. Also, various kinds of ribbon may be fed past a printhead in accordance with the invention.

What is claimed is:

1. For use in a printer of the kind that employs a multi-electrode printhead mounted on a carrier for engaging a printing ribbon in sweeping print motions along a print line to inject printing currents that are selectively supplied from a set of electrode drivers for causing marking of a receiving medium for graphic printing operation characterized by a forward direction of motion along the print line, a ribbon feed arrangement comprising:

supply means for supplying a printing ribbon, takeup means for taking said ribbon from said supply means, path means for defining a ribbon path between said supply means and said takeup means that extends said ribbon around said printhead;

metering means for feeding said ribbon, said metering means including a pair of cooperating rollers mounted on said carrier and separate from said takeup means, located on the takeup side of said printhead, that nip said ribbon and drive means for coupling motion corresponding to carrier movement relative to said receiving medium to at least one of said rollers;

coupling control means for selectively enabling and disabling said metering means; and means for connecting one of said rollers to provide a return path for printing currents that extend from said ribbon to said electrode drivers.

2. A ribbon feed arrangement according to claim 1 wherein said drive means comprises a connection for transmitting carrier motion that causes the peripheral speed of said at least one of said rollers to be substantially equal to the carrier speed.

3. For use in a printer of the kind that employs a multi-electrode printhead mounted on a carrier for engaging a printing ribbon in sweeping print motions along a print line to inject printing currents that are selectively supplied from a set of electrode drivers for causing marking of a receiving medium for graphic printing operation characterized by a forward direction of motion along the print line, a ribbon feed arrangement comprising:

supply means mounted on said carrier for supplying a printing ribbon;

takeup means mounted on said carrier for taking said ribbon from said supply means;

path means for defining a ribbon path between said supply means and said takeup means that extends said ribbon around said printhead;

metering means for feeding said ribbon, said metering means including a pair of cooperating rollers mounted on said carrier and separate from said takeup means, located on the takeup side of said printhead, that nip said ribbon and drive means for coupling motion corresponding to carrier movement relative to said receiving medium to at least one of said rollers;

coupling control means for selectively enabling and disabling said metering means; and means for connecting one of said rollers to provide a return path for printing currents that extend from said ribbon to said electrode drivers.

4. A ribbon feed arrangement according to claim 3 wherein said coupling control means enables said metering means for the graphic printing type of printing operation.

5. A ribbon feed arrangement according to claim 3 wherein said drive means includes a cable that is fixed at either end and is wrapped around a shaft that moves with said carrier.

6. A ribbon feed arrangement according to claim 5 wherein said coupling control means enables said drive means for printer operations that result in the formation of marks on said receiving medium.

7. A ribbon feed arrangement according to claim 3 wherein said coupling control means enables said metering means for forward motion of said carrier.

8. A ribbon feed arrangement according to claims 3, 4 or 5 wherein a tension controlled ribbon brake is arranged on the ribbon feed path on the supply side of said printhead to brake said ribbon so that tension occurring at said printhead will remain within a preselected range.

9. A ribbon feed arrangement according to claim 8 wherein said brake cooperates with a tension controlling arm that has a range of operations for ribbon slack removal.

10. A ribbon feed arrangement according to claim 3, 4 or 5 wherein said drive means includes means for coupling relative carrier motion to said takeup means and wherein disabling means, responsive to tension on the takeup side of said rollers, is provided for disabling said takeup means for takeup tension excursions above a preselected value.

11. A ribbon feed arrangement according to claim 3 wherein said drive means comprises a connection for transmitting carrier motion that causes the peripheral speed of said at least one of said rollers to be substantially equal to the carrier speed.

12. A ribbon feeding arrangement for use in a printer of the kind that employs a multi-electrode printhead mounted on a carrier that moves to define a print line relative to a frame mounted platen for a receiving medium, said printhead, during printing operation in a forward carrier motion direction, acting to inject currents selectively supplied by a set of electrode drivers into a ribbon to cause formation of marks on said receiving medium, said ribbon feeding arrangement comprising:

a supply reel for said ribbon mounted on said carrier;

a takeup reel for said ribbon mounted on said carrier;

means defining a ribbon path that extends from said supply reel to said takeup reel and past said printhead;

ribbon metering apparatus for feeding said ribbon, including a pair of metering nip rollers mounted on said carrier located on the ribbon path between said printhead and said takeup reel; and a shaft mounted on said carrier and coupled to be rotated by a cable at a rate corresponding to movement of said carrier along said print line;

a signal controlled clutch connecting said shaft to one of said rollers and having engaged and disengaged states;

logic for signaling said clutch to the engaged state for at least forward printing operation; and a circuit connection between at least one of said rollers and said set of electrode drivers for providing a return path for said injected currents.

* * * * *